US011028559B2

(12) United States Patent
Kozui

(10) Patent No.: US 11,028,559 B2
(45) Date of Patent: Jun. 8, 2021

(54) SLEWING-TYPE HYDRAULIC WORK MACHINE

(71) Applicant: KOBELCO CONSTRUCTION MACHINERY CO., LTD., Hiroshima (JP)

(72) Inventor: Masatoshi Kozui, Hiroshima (JP)

(73) Assignee: KOBELCO CONSTRUCTION MACHINERY CO., LTD., Hiroshima (JP)

( * ) Notice: Subject to any disclaimer, the term of this patent is extended or adjusted under 35 U.S.C. 154(b) by 0 days.

(21) Appl. No.: 16/962,290

(22) PCT Filed: Nov. 30, 2018

(86) PCT No.: PCT/JP2018/044191
§ 371 (c)(1),
(2) Date: Jul. 15, 2020

(87) PCT Pub. No.: WO2019/159495
PCT Pub. Date: Aug. 22, 2019

(65) Prior Publication Data

US 2020/0370279 A1 Nov. 26, 2020

(30) Foreign Application Priority Data

Feb. 15, 2018 (JP) ..... JP2018-024797

(51) Int. Cl.
*E02F 9/22* (2006.01)

(52) U.S. Cl.
CPC ..... *E02F 9/2296* (2013.01); *E02F 9/2285* (2013.01); *E02F 9/2242* (2013.01); *E02F 9/2267* (2013.01)

(58) Field of Classification Search
CPC ..... E02F 9/2296; E02F 9/2285; E02F 9/2242; E02F 9/2267; E02F 9/22; E02F 3/43;
(Continued)

(56) References Cited

U.S. PATENT DOCUMENTS 5,134,853 A * 8/1992 Hirata ..... E02F 9/2225 60/420
5,784,883 A * 7/1998 Ohkura ..... B60W 10/06 60/327
(Continued)

FOREIGN PATENT DOCUMENTS

JP 58-153829 A 9/1983
JP 62-55337 A 3/1987
(Continued)

OTHER PUBLICATIONS

International Search Report dated Feb. 19, 2019 in PCT/JP2018/044191 filed on Nov. 30, 2018, 1 page.

*Primary Examiner* — Thomas E Lazo
(74) *Attorney, Agent, or Firm* — Oblon, McClelland, Maier & Neustadt, L.L.P.

(57) ABSTRACT

Provided is a slewing-type hydraulic work machine including a boom raising working pressure detection unit that detects boom raising working pressure, and a capacity control device that controls a slewing motor capacity during a slewing and boom-raising operation and performs detecting an actual slewing distribution factor correspondence value corresponding to a ratio of energy distributed to a slewing motor to energy of discharged hydraulic oil, setting a boundary value of the actual slewing distribution factor correspondence value to limit the ratio more with increase in boom raising working pressure, and a capacity operation of making the slewing motor capacity higher than a limit capacity within a slewing priority allowable period until the actual slewing distribution factor correspondence value reaches the boundary value during the slewing and boom-raising operation and limiting the slewing motor capacity to the limit capacity or less after the slewing priority allowable period.

8 Claims, 8 Drawing Sheets

(58) Field of Classification Search
CPC ..... F15B 11/16; F15B 11/17; F15B 11/02; F15B 11/028; F15B 2211/7058; F15B 11/63; F15B 11/6313
See application file for complete search history.

(56) References Cited

U.S. PATENT DOCUMENTS

| | | | | |
|---|---|---|---|---|
| 6,981,371 | B2 * | 1/2006 | Imanishi | E02F 9/2225 60/420 |
| 9,366,010 | B2 * | 6/2016 | Komiyama | E02F 9/128 |
| 9,803,339 | B2 * | 10/2017 | Nanjo | F15B 21/14 |

FOREIGN PATENT DOCUMENTS

| | | | |
|---|---|---|---|
| JP | 7-27106 | A | 1/1995 |
| JP | 7-190003 | A | 7/1995 |
| JP | 2003-206903 | A | 7/2003 |

* cited by examiner

SLEWING-TYPE HYDRAULIC WORK MACHINE

TECHNICAL FIELD

The present invention relates to a slewing-type hydraulic work machine such as a hydraulic excavator.

BACKGROUND ART

Conventionally known is a slewing-type hydraulic work machine including: a slewing motor that slews a slewing body by hydraulic oil supplied thereto; a work device mounted on the slewing body and including a boom capable of being raised and lowered; a boom actuator that raises and lowers the boom by hydraulic oil supplied thereto; and an oil pressure supply device capable of supplying the hydraulic oil to both the slewing motor and the boom actuator, the oil pressure supply device including at least one hydraulic pump.

As this type of slewing-type hydraulic work machine, Patent Literature 1 discloses a slewing-type hydraulic work machine including a variable displacement type hydraulic motor as the slewing motor, a first hydraulic pump for main driving of the slewing motor, a second hydraulic pump for main driving of the boom actuator, a merging valve, and a controller. The merging valve is opened, when the speed of the boom actuator is required to be increased, to allow the hydraulic oil from the first pump to be combined with the hydraulic oil from the second pump and to be supplied to the boom actuator. The controller controls the amount of absorption of the slewing motor, that is, the capacity of the variable displacement type hydraulic motor, based on respective values of the slewing angle to be reached, the lifting height of the boom (values entered for hydraulic oil flow amount into the boom actuator and the moment of inertia of the slewing body, which are input in advance, and a value detected for driving pressure of the boom actuator.

However, for a work machine of a type in which hydraulic oil is supplied from the hydraulic pump included in the oil pressure supply device to both the slewing motor and the boom actuator as described above, it is difficult to simultaneously satisfy two requirements, namely, securing slewing torque for enabling acceleration to be performed sufficiently upon the start of slewing and securing driving force enough to raise the boom. Specifically, large slewing torque is required to start an upper slewing body, which is an object to be driven by the slewing motor and has large moment of inertia, from a stopped state at acceleration required by an operator, but setting the capacity of the slewing motor to a large value for securing the slewing torque involves reduction in the amount of hydraulic oil to be supplied from the hydraulic pump to the boom actuator. The load for driving the boom actuator, if being large at the time, makes it difficult to drive the boom in the raising direction at a speed required by an operator. These hinder a tip attachment of the work device from being actuated in a locus intended by the operator.

Patent Literature 1 described above indicates no suggestion on any means for sufficiently securing slewing torque upon the above start of slewing or securing the boom raising speed under a high load as described above. Although Patent Literature 1 discloses calculating an absorption flow rate of the slewing motor (that is, motor capacity) based on pre-input values for a slewing angle to be reached, lifting height of the boom, and the moment of inertia of the slewing body and changing the capacity of the slewing motor so as to obtain the calculated absorption flow rate, it is not easy either to preliminarily input the target slewing position and height position and the moment of inertia of the slewing body or to perform complicated arithmetic control based on the input values. Furthermore, since the moment of inertia of the slewing body depends on the posture of the work device and also the weight of soil loaded on a bucket, and the like, it is difficult to accurately input the moment of inertia and calculate an appropriate motor capacity based thereon.

CITATION LIST

Patent Literature

Patent Literature 1: Japanese Patent Application Laid-Open No. 62-55337

SUMMARY OF INVENTION

An object of the present invention is to provide a slewing-type hydraulic work machine that includes a slewing motor that slews an upper slewing body, a boom actuator that raises and lowers a boom of a work device, and a hydraulic pump connected to each of the slewing motor and the boom actuator, the slewing-type hydraulic work machine being capable of causing the boom to make a rising motion at a sufficient speed regardless of working pressure of the boom actuator while securing sufficient slewing torque for slewing start, during the performance of a slewing and boom-raising operation.

As means for achieving the above object, the present inventor has found out rendering the slewing motor capacity large, at the time of slewing start requiring large slewing torque, to give priority to securing the slewing torque, and rendering the slewing motor capacity small, after the slewing motion progresses to a certain extent, to give priority to securing the boom raising speed by driving the boom actuator. Furthermore, regarding timing for switching the priority, the present inventor has focused on the fact that the ratio of energy distributed to the slewing motor to energy of the hydraulic oil discharged from the hydraulic pump, namely, a slewing energy distribution factor, increases after the slewing motor starts, thereby having found out setting a boundary value of the energy distribution factor so as to limit the energy distribution factor as the working pressure of the boom actuator increases, and rendering the capacity of the slewing motor large until the actual slewing energy distribution factor reaches the boundary value and rendering the capacity of the slewing motor small after the actual slewing energy distribution factor reaches the boundary value; this makes it possible to give priority to securing the slewing torque immediately after the slewing start and thereafter change the priority according to the working pressure of the boom actuator.

The present invention has been made from such a viewpoint. Provided is a slewing-type hydraulic work machine including: a lower travelling body; an upper slewing body mounted on the lower travelling body so as to be capable of being slewed; a work device mounted on the upper slewing body, the work device including a boom connected to the upper sewing body so as to be capable of being raised and lowered; a slewing motor formed of a variable displacement type hydraulic motor and operated by hydraulic oil supplied to the slewing motor to slew the upper slewing body in response to the supply of the hydraulic oil; a boom actuator that is operated by hydraulic oil supplied to the boom actuator to raise and lower the boom; an oil pressure supply device including at least one hydraulic pump that discharges hydraulic oil to be supplied to the variable displacement type hydraulic motor and the boom actuator, the at least one hydraulic pump including a distribution pump that is connectable to both the slewing motor and the boom actuator to distribute the hydraulic oil to the slewing motor and the boom actuator; a slewing control device configured to control a direction and a flow rate of the hydraulic oil supplied from the oil pressure supply device to the slewing motor in accordance with a slewing command operation that is applied to the slewing control device for slewing the upper slewing body; a boom control device configured to control a flow rate of the hydraulic oil supplied from the oil pressure supply device to the boom actuator in accordance with a boom raising command operation that is applied to the boom control device for actuating the boom in a rising direction; a boom raising working pressure detection unit that detects boom raising working pressure corresponding to pressure of the hydraulic oil supplied from the oil pressure supply device to the boom actuator to drive the boom in the rising direction; and a capacity control device configured to control a slewing motor capacity that is a capacity of the slewing motor based on the boom raising working pressure detected by the boom raising working pressure detection unit during a performance of a slewing and boom-raising operation in which the slewing command operation is applied to the slewing control device and the boom raising command operation is applied to the boom control device, simultaneously. The capacity control device includes: a distribution factor correspondence value detection unit that detects an actual slewing distribution factor correspondence value that is a value that increases and decreases correspondingly to a slewing energy distribution factor that is a ratio of energy actually distributed to the slewing motor to energy of the hydraulic oil discharged from the oil pressure supply device during the performance of the slewing and boom-raising operation; a boundary value setting unit that sets a boundary value for the actual slewing distribution factor correspondence value, the boundary value setting unit configured to change the boundary value according to the boom raising working pressure to limit the slewing energy distribution factor more strictly with increase in the boom raising working pressure; and a motor capacity operation unit configured to render the slewing motor capacity higher than a preset limit capacity within a slewing priority allowable period after the slewing motor starts until the actual slewing distribution factor correspondence value reaches the boundary value during the performance of the slewing and boom-raising operation and configured to limit the slewing motor capacity to the limit capacity or less after the actual slewing distribution factor correspondence value reaches the boundary value.

DESCRIPTION OF EMBODIMENT

A preferred embodiment of the present invention will be described with reference to the drawings.

Figure 1:
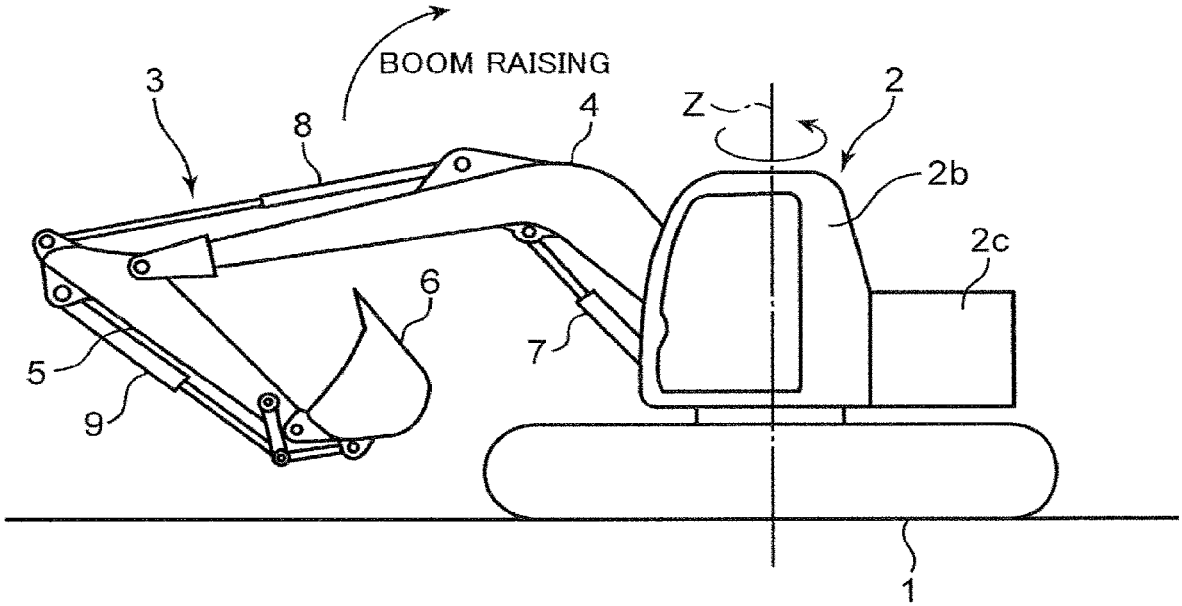
FIG. 1 is a view showing a hydraulic excavator that is a hydraulic work machine according to an embodiment of the present invention.

FIG. 1 shows a hydraulic excavator corresponding to a work machine according to each embodiment. The hydraulic excavator includes a crawler-type lower travelling body 1, an upper slewing body 2 mounted on the lower travelling body 1, and an excavation attachment 3 installed in the upper slewing body 2.

The upper slewing body 2 is mounted on the lower travelling body 1 rotatably about a slewing central axis Z perpendicular to a travelling surface of the lower travelling body 1. The upper slewing body 2 includes a cab 2*b* and a counterweight 2*c*.

The excavation attachment 3 includes a boom 4 capable of being raised and lowered, an arm 5 attached to the distal end of the boom 4, a bucket 6 attached to the distal end of the arm 5, and a plurality of hydraulic cylinders for moving the boom 4, the arm 5, and the bucket 6, respectively: namely, a pair of boom cylinders 7, a pair of arm cylinders 8, and a pair of bucket cylinders 9. Out of them, the pair of boom cylinders 7 corresponds to a boom actuator that is operated by hydraulic oil supplied to the boom actuator to actuate the boom 4 in raising and lowering directions.

The work machine according to the present invention is not limited to such a hydraulic excavator. The present invention can be applied to various work machines including an upper slewing body and a work device mounted on the upper slewing body and including the boom.

Figure 2:
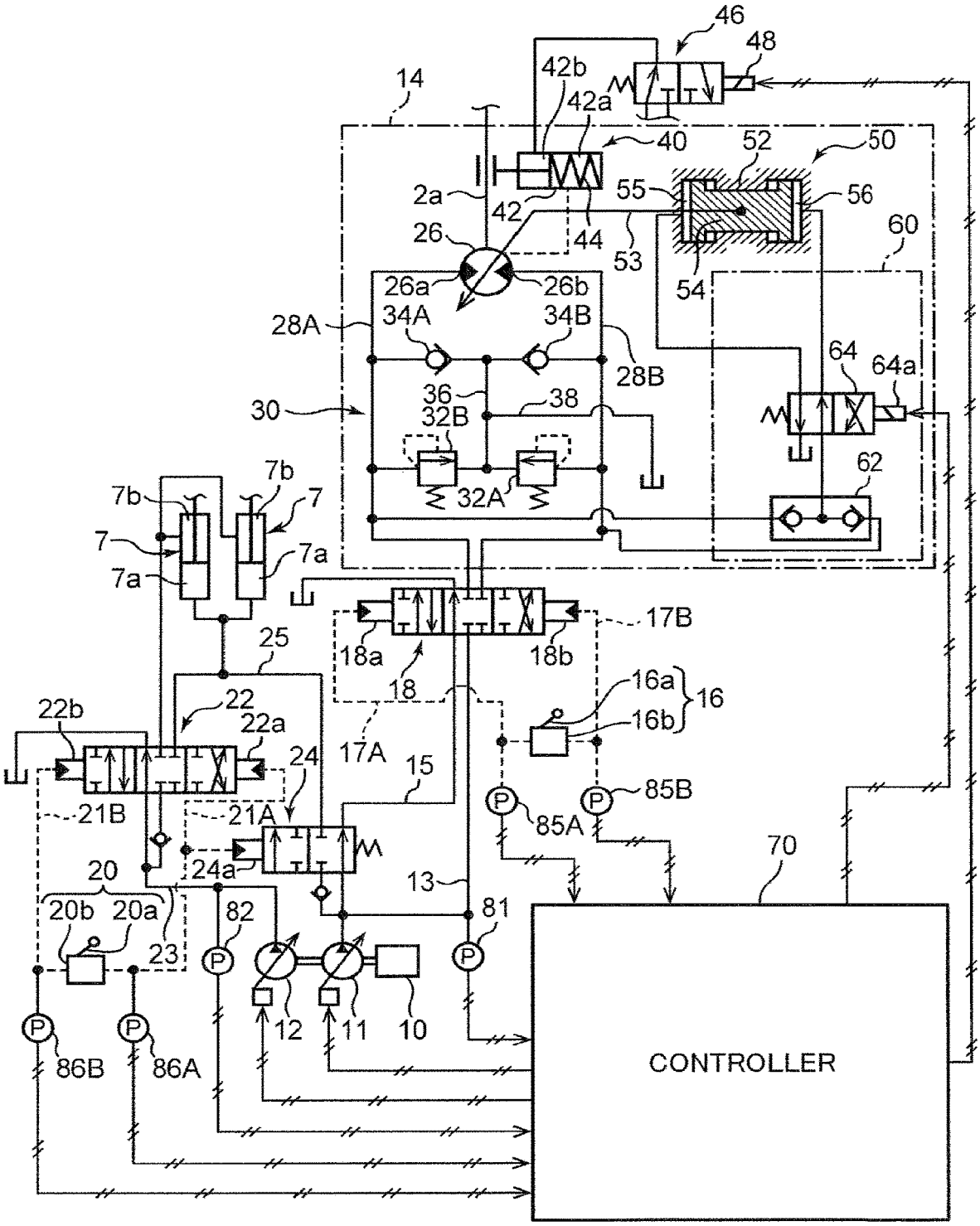
FIG. 2 is a diagram showing a hydraulic circuit mounted on the hydraulic excavator.

FIG. 2 shows a part of a hydraulic circuit mounted on the hydraulic excavator, the part provided to slew the upper slewing body 2 and to raise and lower the boom 4. This circuit includes an oil pressure supply device, a slewing motor unit 14, a slewing operation device 16, a slewing control valve 18, a boom operation device 20, a boom control valve 22, and a combined-flow selector valve 24. Furthermore, the hydraulic excavator includes a plurality of sensors equipped in the hydraulic circuit, and a controller 70 connected to the hydraulic circuit to control the action of the hydraulic circuit.

The oil pressure supply device includes at least one hydraulic pump, namely, a first hydraulic pump 11 and a second hydraulic pump 12 in this embodiment. The first and second hydraulic pumps 11 and 12 are connected to an engine 10 mounted on the upper slewing body 2 and driven by the engine 10 to thereby discharge hydraulic oil to be supplied to the slewing motor unit 14 and the pair of boom cylinders 7. The first hydraulic pump 11 is connectable to the slewing motor unit 14 through the slewing control valve 18 and the second hydraulic pump 12 is connectable to the boom cylinders 7 through the boom control valve 22. The first hydraulic pump 11 is further connectable to the boom cylinders 7 through the combined-flow selector valve 24. The first hydraulic pump 11, thus, corresponds to a distribution pump that is connectable to both the slewing motor unit 14 and the pair of boom cylinders 7 so as to distribute hydraulic oil to the slewing motor unit 14 and the pair of boom cylinders 7.

The slewing motor unit 14 is a hydraulic actuator that allows hydraulic oil to be supplied thereto and thereby slews the upper slewing body 2, including a slewing motor body 26, a rightward slewing pipe line 28A, a leftward slewing pipe line 28B, a brake circuit 30, a slewing parking brake 40, a capacity switching unit 50, and a hydraulic supply control unit 60.

The slewing motor body 26 is connected to the upper slewing body 2, for example, a slewing shaft 2*a* thereof, and operated by hydraulic oil supplied to the slewing motor body 26 to apply slewing torque to the upper slewing body 2 so as to slew the upper slewing body 2. Specifically, the slewing motor body 26 includes a rightward slewing port 26*a* connected to the rightward slewing pipe line 28A and a leftward slewing port 26*b* connected to the leftward slewing pipe line 28B, being configured to apply slewing torque to the upper slewing body 2 in a direction to make the upper slewing body 2 perform a rightward slewing operation, while discharging hydraulic oil through the leftward slewing port 26*b*, when hydraulic oil is supplied to the rightward stewing port 26*a*, and configured to apply slewing torque to the upper slewing body 2 in a direction to make the upper slewing body 2 perform a leftward slewing operation, while discharging the hydraulic oil through the rightward slewing port 26*a*, when hydraulic oil is supplied to the leftward slewing port 26*b*.

The slewing motor body 26 includes a variable displacement type hydraulic motor having variable capacity (geometric displacement). The slewing torque applied to the upper sewing body 2 by the slewing motor body 26 increases with increase in the capacity of the sewing motor body 26.

The brake circuit 30 includes a rightward slewing relief valve 32A, a leftward slewing relief valve 32B, a rightward slewing check valve 34A, a leftward slewing check valve 34B, an intermediate oil passage 36, and a makeup line 38. The rightward slewing relief valve 32A and the rightward slewing check valve 34A are interconnected through the intermediate oil passage 36 to form a rightward slewing brake valve. Specifically, the rightward slewing relief valve 32A is opened by the raised pressure in the leftward slewing oil passage (discharge side oil passage) 28B when the slewing control valve 18 is closed during rightward slewing, thereby allowing hydraulic oil to be replenished to the rightward slewing oil passage (suction side oil passage) 28A from the leftward slewing oil passage 28B through the rightward slewing relief valve 32A, the intermediate oil passage 36, and the rightward slewing check valve 34A. Similarly, the leftward slewing relief valve 32B and the leftward slewing check valve 34B are interconnected through the intermediate oil passage 36 to form a leftward slewing brake valve. The makeup line 38 interconnects the intermediate oil passage 36 and a tank to allow hydraulic oil to be sucked up from the tank to the intermediate oil passage 36 through the makeup line 38 by negative pressure in the intermediate oil passage 36, preventing cavitation. The makeup line 38 is provided with a not-graphically-shown back pressure valve.

The slewing parking brake 40 is a brake device for applying mechanical stop holding force to the upper slewing body 2 to keep the upper slewing body 2 in a stopped state at least when the upper slewing body 2 is not driven by the slewing motor body 26. The slewing parking brake 40 is switchable between a brake state of applying the stop holding force to the upper slewing body 2 and a brake release state of releasing the upper slewing body 2 to allow the upper slewing body 2 to be slewed. The slewing parking brake 40 according to the embodiment is a hydraulic negative brake, configured to be switched to the brake release state only when a brake release pressure is supplied and configured to be kept in the brake state when no brake release pressure is supplied. Specifically, the slewing parking brake 40 includes a hydraulic cylinder 42 including a spring chamber 42*a* as a first hydraulic chamber and a brake release chamber 42*b* that is a second hydraulic chamber opposite thereto the first chamber, and a spring 44 loaded in the spring chamber 42*a*. With no supply of the brake release pressure to the brake release chamber 42*b*, the slewing parking brake 40 applies a binding force, that is, the stop holding force, to an appropriate portion of the upper slewing body 2, for example, a slewing shaft 2*a* shown in FIG. 1, based on the elastic force of the spring 44. On the other hand, when the brake release pressure is supplied to the brake release chamber 42*b*, the brake release pressure acts on the hydraulic cylinder 42 as brake release force for releasing the application of the binding force against the elastic force of the spring 44.

The capacity switching unit 50 constitutes a capacity operation device in association with the hydraulic supply control unit 60. In accordance with a capacity switching signal that is input from the controller 70, the capacity operation device switches a slewing motor capacity qms, which is a capacity (geometric displacement) of the slewing motor body 26, between a first capacity qms1 and a second capacity qms2 which is smaller than the first limit capacity.

The capacity operation unit 50, which is configured to switch the capacity of the slewing motor body 26 between the first capacity and the second capacity in accordance with a capacity switching hydraulic pressure that is supplied to the capacity operation unit 50 and controlled by the hydraulic supply control unit 60, includes a capacity operation cylinder 52 enclosing a piston chamber and a capacity operation piston 54 loaded in the piston chamber of the capacity operation cylinder 52. The capacity operation piston 54, which is axially displaceable (slidable against the inner peripheral surface of the capacity operation cylinder 52) in the piston chamber, is connected to the slewing motor body 26 so as to change the slewing motor capacity qms through the axial displacement thereof. For example, when the slewing motor body 26 is an axial piston type, inclination of a swash plate is changed.

Specifically, the capacity operation piston 54 is connected to the slewing motor body 26 through a rod 53 extending from the capacity operation piston 54 so as to penetrate the first hydraulic chamber 55, while partitioning the piston chamber of the capacity operation cylinder 52 into a first hydraulic chamber 55 and a second hydraulic chamber 56. The capacity operation piston 54 is displaced, by the capacity switching hydraulic pressure introduced into the first hydraulic chamber 55, in a direction to increase the volume of the first hydraulic chamber 55 (rightward in FIG. 1) to render the slewing motor capacity equal to the first capacity qms1; meanwhile, the capacity operation piston 54 is displaced, by the capacity switching hydraulic pressure introduced into the second hydraulic chamber 56, in a direction to increase the volume of the second hydraulic chamber 56 (leftward in FIG. 1) to render the slewing motor capacity equal to qms at the second capacity qms2.

The hydraulic supply control unit 60 introduces a part of the hydraulic oil supplied from the first hydraulic pump 11 to the slewing motor body 26 to the capacity switching unit 50, thereby switching the position of the capacity operation piston 54 with use of the pressure of the hydraulic oil. In other words, the hydraulic supply control unit 60 according to the embodiment controls the operation of the capacity operation unit 50 by use of the pressure of the hydraulic oil for driving the slewing motor body 26 as the capacity switching hydraulic pressure.

The hydraulic supply control unit 60 includes a shuttle valve 62 and an oil pressure supply selector valve 64 as shown in FIG. 2. The shuttle valve, interposed between the oil pressure supply selector valve 64 and each of the rightward slewing oil passage 28A and the leftward slewing oil passage 28B, is opened to allow the hydraulic oil selected from hydraulic oil flowing through the rightward slewing oil passage 28A and the hydraulic oil flowing through the leftward slewing oil passage 28B, the selected hydraulic oil having a higher pressure than that of the other, to be supplied to a primary side of the oil pressure supply selector valve 64. The oil pressure supply selector valve 64, interposed between the shuttle valve 62 and each of the first and second hydraulic chambers 55 and 56 of the capacity operation cylinder 52, is switched between a first switching position for allowing the pressure of the hydraulic oil selected by the shuttle valve 62 to be supplied to the first hydraulic chamber 55 as the capacity switching hydraulic pressure and a second switching position for allowing the pressure of the selected hydraulic oil to be supplied to the second hydraulic chamber 56. The oil pressure supply selector valve 64 according to the embodiment includes an electromagnetic selector valve having a solenoid 64*a*, configured to be held at the second switching position with no input of the capacity switching signal from the controller 70 to the solenoid 64*a* and configured to be switched to the first switching position with input of the capacity switching signal to the solenoid 64*a*.

The slewing operation device 16 and the slewing control valve 18 constitute a slewing control device. The slewing control device is configured to be operated, by a slewing command operation applied to the slewing control device for slewing the upper slewing body 2, to allow hydraulic oil to be supplied from the first hydraulic pump 11 to the slewing motor body 26 to thereby activate the slewing motor body 26 and configured to control the supply in accordance with the slewing command operation.

The slewing control valve 18, interposed between the first hydraulic pump 11 and the slewing motor unit 14, is operated to change the direction and the flow rate of the hydraulic oil supplied from the first hydraulic pump 11 to the slewing motor body 26 of the slewing motor unit 14 in accordance with the slewing command operation. Specifically, the slewing control valve 18 includes a pilot-controlled three-position hydraulic selector valve including a rightward slewing pilot port 18*a* and a leftward slewing pilot port 18*b*. With no input of the pilot pressure to either of the pilot ports 18*a* and 18*b*, the slewing control valve 18 keeps its neutral position, which is a central position in FIG. 2, to be closed to block both the slewing pipe lines 28A and 28B from the first hydraulic pump 11. By a pilot pressure input to the rightward slewing pilot port 18*a*, the slewing control valve 18 is shifted from the neutral position to the rightward slewing position, which is the left position in FIG. 2, by a stroke corresponding to the magnitude of the pilot pressure, to allow hydraulic oil to be supplied from the first hydraulic pump 11 to the rightward slewing port 26*a* of the slewing motor body 26 through the first pump line 13 and the rightward slewing pipe line 28A at a flow rate corresponding to the stroke and to allow hydraulic oil discharged through the leftward slewing port 26*b* to return to the tank through the leftward slewing pipe line 28B. Conversely, by a pilot pressure input to the leftward slewing pilot port 18*b*, the slewing control valve 18 is shifted from the neutral position to the leftward slewing position, which is the right position in FIG. 2, by a stroke corresponding to the magnitude of the pilot pressure, to allow hydraulic oil to be supplied from the first hydraulic pump 11 to the leftward slewing port 26*b* of the slewing motor body 26 through the leftward slewing pipe line 28B at a flow rate corresponding to the stroke and to allow hydraulic oil discharged through the rightward slewing port 26*a* to return to the tank through the rightward slewing pipe line 28A.

The slewing operation device 16 includes a slewing operation lever 16*a* and a slewing pilot valve 16*b*. The slewing operation lever 16*a* is a slewing operation member, being capable of rotational movement in a direction of the slewing command operation that is applied to the slewing operation lever 16*a* by an operator. The slewing pilot valve 16*b* includes an inlet port connected to a not-graphically-shown pilot oil pressure source and a pair of outlet ports, which outlet ports are connected to a rightward slewing pilot port 18*a* and a leftward slewing pilot port 18*b* of the slewing control valve 18 through a rightward slewing pilot line 17A and a leftward slewing pilot line 17B, respectively. The slewing pilot valve 16*b* is linked to the slewing operation lever 16*a* to be opened so as to allow pilot pressure corresponding to the magnitude of the slewing command operation to be supplied from the pilot oil pressure source to the pilot port that is selected from the right and leftward slewing pilot ports 18*a* and 18*b* and corresponding to the direction of the slewing command operation applied to the slewing operation lever 16*a*.

The boom operation device 20, the boom control valve 22, and the combined-flow selector valve 24 constitute a boom control device. The boom control device controls the direction and the flow rate of the hydraulic oil supplied from the oil pressure supply device to the boom cylinders 7, which is a boom actuator, in accordance with a boom raising command operation and a boom lowering command operation applied to the boom control device for actuating the boom 4 in the rising direction and the falling direction, respectively.

Each of the boom cylinders 7 includes a bottom chamber 7*a* and a rod chamber 7*b* opposite thereto. The boom cylinder 7 is operated in an expanding direction by hydraulic oil supplied to the bottom chamber 7*a* to make the boom 4 perform a motion in the rising direction (boom rising motion) and operated in a contracting direction by hydraulic oil supplied to the rod chamber 7*b* to make the boom 4 perform a motion in the falling direction (boom falling motion).

The boom control valve 22, interposed between the second hydraulic pump 12 and the boom cylinder 7, is operated to change the direction and the flow rate of the hydraulic oil supplied from the second hydraulic pump 12 to the boom cylinder 7. Specifically, the boom control valve 22 is formed of a pilot-controlled three-position hydraulic selector valve including a boom raising pilot port 22*a* and a boom lowering pilot port 22*b*. With no input of pilot pressure to either of the pilot ports 22*a* and 22*b*, the boom control valve 22 keeps its neutral position, which is a central position in FIG. 2, to be closed to block both of the bottom chamber 7*a* and the rod chamber 7*b* of the boom cylinder 7 from the second hydraulic pump 12. By a pilot pressure input to the boom raising pilot port 22*a*, the boom control valve 22 is shifted from the neutral position to the boom raising position, which is the right position in FIG. 2, by a stroke corresponding to the magnitude of the pilot pressure, to allow hydraulic oil to be supplied from the second hydraulic pump 12 to the bottom chamber 7*a* of each of the boom cylinders 7 through the second pump line 23 at a flow rate corresponding to the stroke and to allow hydraulic oil discharged from the rod chamber 7*b* to return to the tank. Conversely, by a pilot pressure input to the boom lowering pilot port 22*b*, the boom control valve 22 is shifted from the neutral position to the boom lowering position, which is the left position in FIG. 2, by a stroke corresponding to the magnitude of the pilot pressure, to allow hydraulic oil to be supplied from the second hydraulic pump 12 to the rod chamber 7*b* of each of the boom cylinders 7 through the second pump line 23 at a flow rate corresponding to the stroke and to allow hydraulic oil discharged from the bottom chamber 7*a* to return to the tank.

The boom operation device 20 includes a boom operation lever 20*a* and a boom pilot valve 20*b*. The boom operation lever 20*a* is a boom operation member, being capable of rotational movement in a direction in which the boom command operation is applied to the boom operation lever 20*a* by an operator. The boom pilot valve 20*b* includes an inlet port connected to the pilot oil pressure source and a pair of outlet ports, which outlet ports are connected to the boom raising pilot port 22*a* and the boom lowering pilot port 22*b* of the boom control valve 22 through a boom raising pilot line 21A and a boom lowering pilot line 21B, respectively. The boom pilot valve 20*b* is linked to the boom operation lever 20*a* to be opened so as to allow pilot pressure corresponding to the magnitude of the boom command operation to be supplied from the pilot oil pressure source to the pilot port that is selected from the boom raising and lowering pilot ports 22*a* and 22*b* and corresponding to the direction of the boom command operation applied to the boom operation lever 20*a*. For example, with the boom raising command operation applied to the boom operation lever 20*a*, the boom pilot valve 20*b* is opened to allow pilot pressure corresponding to the magnitude of the boom raising command operation to be supplied to the boom raising pilot port 22*a*.

The combined-flow selector valve 24, interposed between the first hydraulic pump 11 and the pair of boom cylinders 7, is configured to be opened, with the boom raising command operation applied to the boom operation device 20, to allow hydraulic oil discharged from the first hydraulic pump 11 to be combined with the hydraulic oil discharged from the second hydraulic pump 12 and to be supplied to the bottom chamber 7*a* of the boom cylinder 7, thereby enabling the speed of the boom rising motion caused by expansion of the boom cylinder 7 to be increased.

The combined-flow selector valve 24 according to the embodiment is formed of a pilot-controlled two-position hydraulic selector valve including a single pilot port 24*a*, which is connected to the boom raising pilot line 21A. With no supply of pilot pressure to the pilot port 24*a*, the combined-flow selector valve 24 is kept at the right position in FIG. 2, namely, a combined-flow prevention position for preventing hydraulic oil from being supplied from the first hydraulic pump 11 to the pair of boom cylinders 7. On the other hand, by a pilot pressure (boom raising pilot pressure) supplied to the pilot port 24*a* through the boom raising pilot line 21A, the combined-flow selector valve 24 is shifted to the left position in FIG. 2, namely, a combined-flow allowing position for allowing hydraulic oil to be supplied from the first hydraulic pump 11 to the pair of boom cylinders 7.

Figure 3:
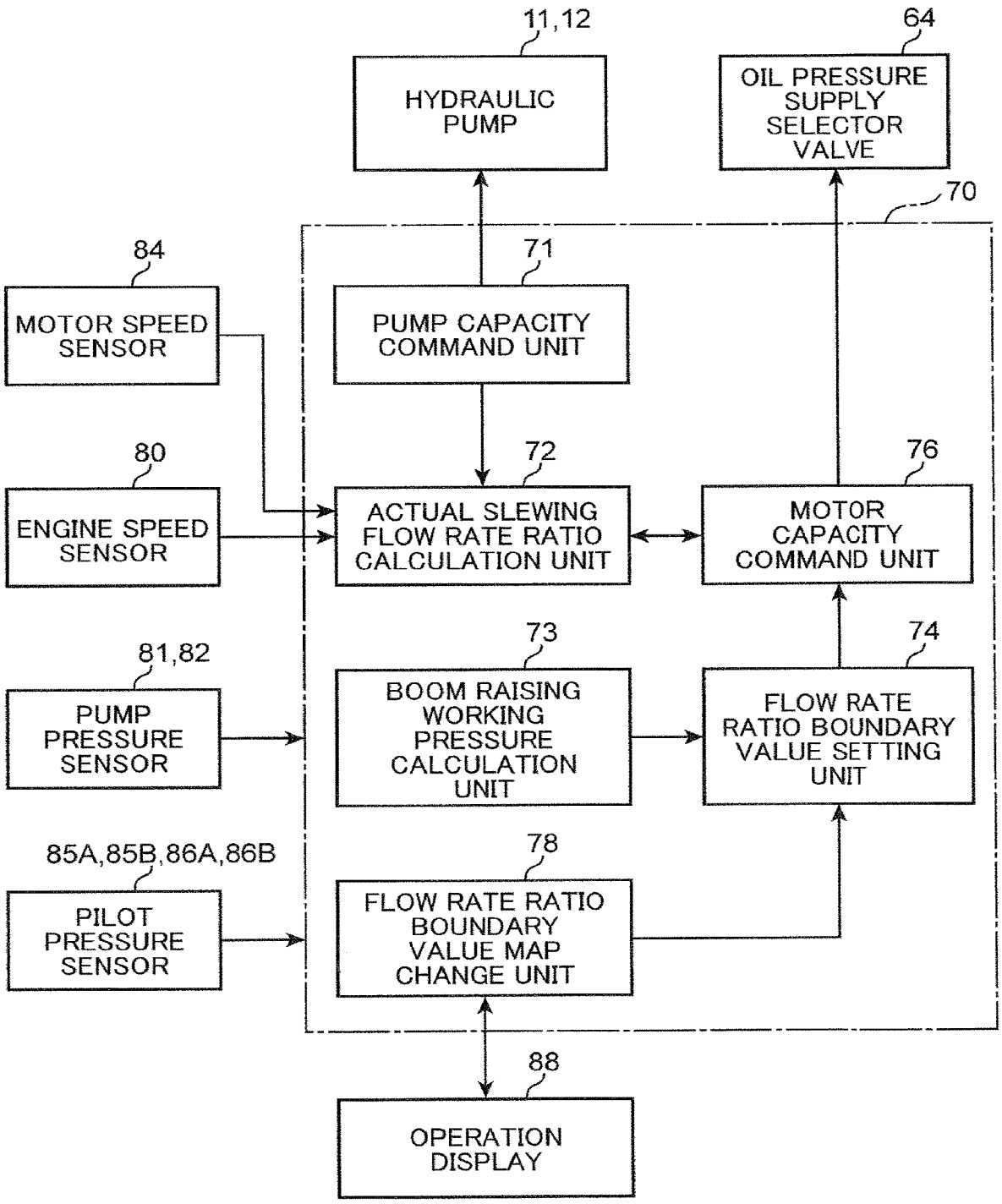
FIG. 3 is a block diagram showing a functional configuration of a controller connected to the hydraulic circuit.

The plurality of sensors includes a first pump pressure sensor 81, a second pump pressure sensor 82, a rightward slewing pilot pressure sensor 85A, a leftward slewing pilot pressure sensor 85B, a boom raising pilot pressure sensor 86A, a boom lowering pilot pressure sensor 86B, an engine speed sensor 80 and a motor speed sensor 84 shown in FIG. 3.

The first pump pressure sensor 81 and the second pump pressure sensor 82 are pump pressure detectors that detect the pressure of respective hydraulic oils discharged from the first hydraulic pump 11 and the second hydraulic pump 12, namely, first pump pressure P1 and second pump pressure P2, respectively. The first pump pressure sensor 81 and the second pump pressure sensor 82 generate a first pump pressure detection signal and a second pump pressure detection signal, which are electric signals corresponding to the first pump pressure P1 and the second pump pressure P2, respectively, and input the signals to the controller 70.

The rightward slewing pilot pressure sensor 85A and the leftward slewing pilot pressure sensor 85B generate pilot pressure detection signals corresponding to rightward slewing pilot pressure and leftward slewing pilot pressure in the rightward slewing pilot line 17A and the leftward slewing pilot line 17B, respectively, and input the signals to the controller 70. The rightward slewing and leftward slewing pilot pressure sensors 85A and 85B, thus, constitute a slewing command operation detector that detects the direction and magnitude of the slewing command operation applied to the slewing operation lever 16*a* of the slewing operation device 16 and provides the detected data to the controller 70.

The boom raising pilot pressure sensor 86A and the boom lowering pilot pressure sensor 86B generate pilot pressure detection signals corresponding to the boom raising pilot pressure and the boom lowering pilot pressure in the boom raising pilot line 21A and the boom lowering pilot line 21B, respectively, and input the signals to the controller 70. The boom raising and boom lowering pilot pressure sensors 85A and 85B, thus, constitute a boom command operation detector that detects the direction and magnitude of the boom command operation applied to the boom operation lever 20*a* of the boom operation device 20 and provides the detected data to the controller 70.

The engine speed sensor 80 detects the rotation speed of the engine 10, namely, an engine speed Ne [rpm], corresponding to the rotational speed of the first and second hydraulic pumps 11 and 12. The engine speed sensor 80, thus, constitutes a pump rotational speed detector. The engine speed sensor 80 generates an engine speed detection signal corresponding to the engine speed Ne, and inputs the signal to the controller 70.

The motor speed sensor 84 detects, which is the number of revolution per unit time (that is, a rotational speed) of the slewing motor body 26 in the slewing motor unit 14, namely, a motor speed Nms [rpm]. The motor speed sensor 84, thus, constitutes a motor rotational speed detector. The motor speed sensor 84 generates a slewing speed detection signal corresponding to the motor speed Nms, and inputs the signal to the controller 70.

The controller 70, which is formed of, for example, a microcomputer, includes, as functions related to slewing drive control and boom raising drive control, a pump capacity command unit 71, an actual slewing flow rate ratio calculation unit 72, a boom raising working pressure determination unit 73, a boundary value setting unit 74, a motor capacity command unit 76, and a flow rate ratio boundary value map change unit 78 shown in FIG. 3.

The pump capacity command unit 71 controls first pump capacity qp1 and second pump capacity qp2, which are respective capacities of the first and second hydraulic pumps 11 and 12 (tilting flow rate, that is, geometric displacement)

based on the first and second pump pressure and each of the pilot pressures detected by the pump pressure sensors 81 and 82 and the pilot pressure sensors 85 and 86. Examples of the control include horsepower control, positive control, complex control thereof, and the like. The horsepower control is a control of setting the first and second pump capacities qp1 and qp2 according to the first and second pump pressure P1 and P2 so as to limit respective horsepowers W1 and W2 required by the first and second pumps 11 and 12 to a horsepower on or below the horsepower curve that is set for the engine 10. The positive control is a control of changing the first and second pump capacities qp1 and qp2 in accordance with the magnitude of command operations applied to the operation levers 16*a* and 20*a*.

The actual slewing flow rate ratio calculation unit 72 calculates an actual slewing flow rate ratio Rqs based on the motor speed Nms and the engine speed Ne detected by the motor speed sensor 84 and the engine speed sensor 80, respectively, during the performance of a slewing and boom-raising operation in which the slewing command operation is applied to the slewing operation device 16 and the boom raising command operation is applied to the boom operation device 20 simultaneously. The actual slewing flow rate ratio Rqs is a ratio of a slewing flow rate Qs, which is a flow rate of the hydraulic oil actually distributed to the slewing motor unit 14, to a pump flow rate Qp, which is the total flow rate of the hydraulic oil discharged from the first and second hydraulic pumps 11 and 12 (Rqs=Qs/Qp) during the performance of the slewing and boom-raising operation; the actual slewing flow rate ratio Rqs is applicable to an actual slewing distribution factor correspondence value that increases with increase in a slewing energy distribution ratio, which is the ratio of the energy of the hydraulic oil actually distributed to the slewing motor unit 14 to the energy of the hydraulic oil discharged from the first and second hydraulic pumps 11 and 12 during the performance of the slewing and boom-raising operation. The specific procedure for calculating the actual slewing flow rate ratio Rqs will be described later.

The boom raising working pressure determination unit 73 constitutes, in association with the first and second pump pressure sensors 81 and 82, a boom raising working pressure detection unit that detects boom raising working pressure Pbr. The boom raising working pressure Pbr is the working pressure of the pair of boom cylinders 7 during the performance of the slewing and boom-raising operation, specifically, the pressure of the hydraulic oil supplied to the bottom chamber 7*a* of each boom cylinder 7. The boom raising working pressure determination unit 73 determines the boom raising working pressure Pbr based on the first and second pump pressure P1 and P2 detected by the first and second pump pressure sensors 81 and 82 during the performance of the slewing and boom-raising operation.

The boundary value setting unit 74 sets a flow rate ratio boundary value Rqsb, which is a boundary value of the actual slewing flow rate ratio Rqs, based on the boom raising working pressure Pbr determined by the boom raising working pressure determination unit 73. Specifically, the boundary value setting unit 74 sets the flow rate ratio boundary value Rqsb so as to decrease the flow rate ratio boundary value Rqsb to lower the priority of the slew drive and raise the priority of the boom raising drive, with increase in the boom raising working pressure Pbr during the performance of the slewing and boom-raising operation, that is, with increase in the load for the boom rising motion. As will be detailed later, the boundary value setting unit 74 according to the embodiment stores a flow rate ratio boundary value map prepared in advance to determine the flow rate ratio boundary value Rqsb based on the boom raising working pressure Pbr, and determines the flow rate ratio boundary value Rqsb based on the flow rate ratio boundary map.

During the slewing and boom-raising operation, the slewing motor capacity command unit 76 judges the necessity of the input of the capacity switching signal to the oil pressure supply selector valve 64 based on the actual slewing flow rate ratio Rqs calculated by the actual slewing flow rate ratio calculation unit 72 and the flow rate ratio boundary value Rqsb determined by the boundary value setting unit 74. Only when the input is necessary, the slewing motor capacity command unit 76 inputs the capacity switching signal to the solenoid 64*a* of the oil pressure supply selector valve 64. Specifically, within a slewing priority allowable period after the slewing is started during the performance of the slewing and boom-raising operation (when the slewing motor unit 14 starts) until the actual slewing flow rate ratio Rqs reaches the flow rate ratio boundary value Rqsb, the motor capacity command unit 76 inputs the capacity switching signal to make the slewing motor capacity qms be the first capacity qms1; after the actual slewing flow rate ratio Rqs reaches the flow rate ratio boundary value Rqsb, the motor capacity command unit 76 stops the input of the capacity switching signal to make the slewing motor capacity qms be the second capacity qms2.

The slewing motor capacity command unit 76, thus, constitutes a slewing motor operation unit that operates the slewing motor capacity qms by inputting the capacity switching signal to the slewing motor unit 14.

The flow rate ratio boundary value map change unit 78 is electrically connected to an operation display 88, which is an input device provided in the cab 2*a*, and configured to change the flow rate ratio boundary value map according to the content of a map change command that is input thereto by an operator through the operation display 88.

Figure 7:
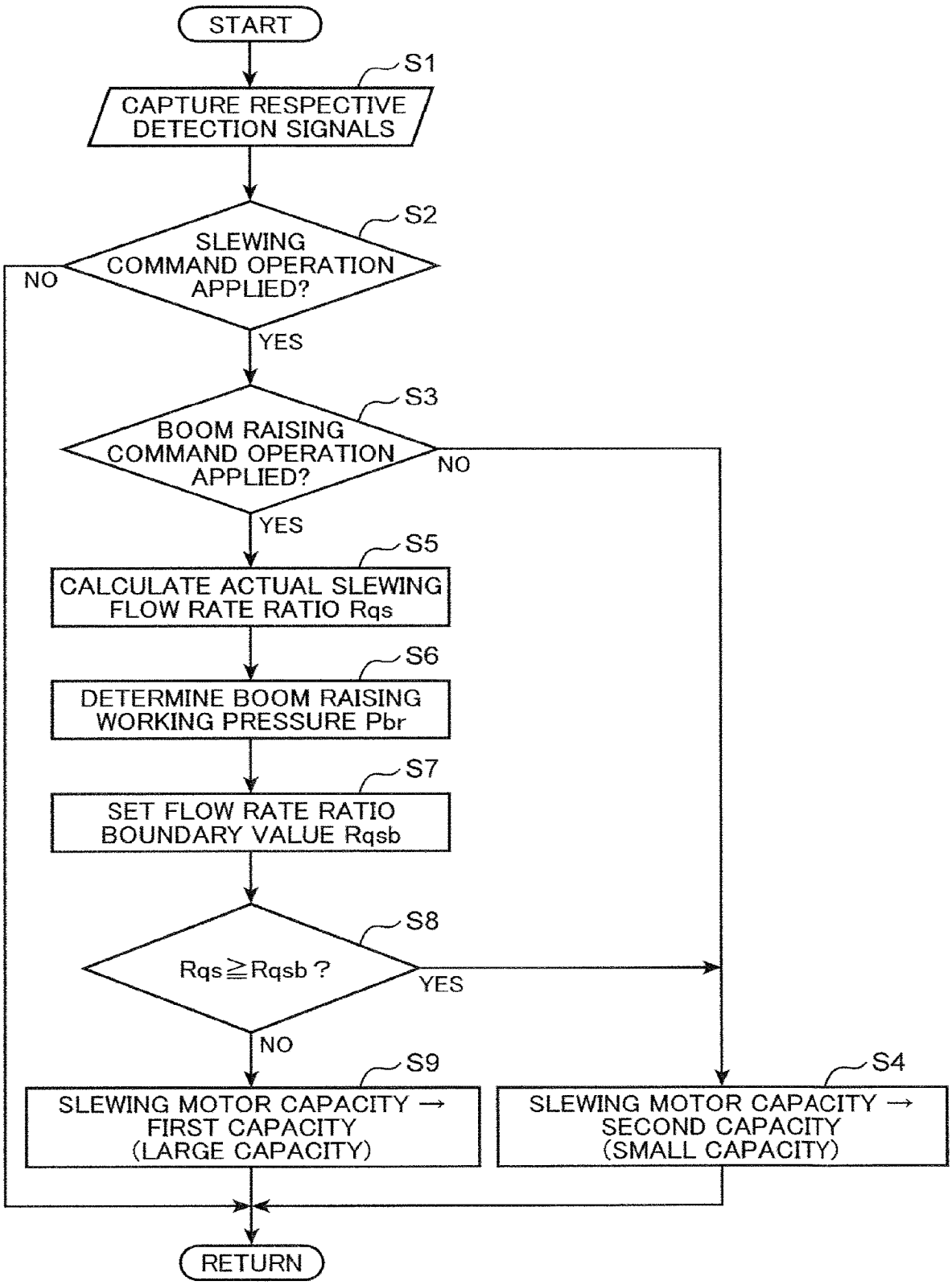
FIG. 7 is a flowchart showing an arithmetic control operation performed by the controller.

Next will be described main actions of the hydraulic excavator with reference to the flowchart of FIG. 7. The flowchart shows an arithmetic control operation executed by the controller 70 on the slewing motor capacity qms.

The controller 70 captures detection signals that are input from respective sensors (step S1), and judges whether the slewing command operation is applied to the slewing operation lever 16*a* of the slewing operation device 16 (step S2). Specifically, judged is whether either one of the rightward slewing pilot pressure and the leftward slewing pilot pressure detected by the slewing pilot pressure sensors 85A and 85B, respectively, exceeds a minute range set in advance, that is, whether the slewing operation lever 16*a* is operated beyond a neutral range. With the judgment that the slewing command operation is not applied (NO in step S2), the controller 70 executes no control of the slewing motor capacity qms.

When the slewing command operation is applied to the slewing operation device 16, the controller 70 further judges whether the boom raising command operation is applied to the boom operation device 20 (step S3). Specifically, judged is whether the boom raising pilot pressure detected by the boom raising pilot pressure sensor 86A exceeds the predetermined minute range, that is, whether the boom operation lever 20*a* is operated beyond the neutral range in the boom raising operation direction.

When the boom raising command operation is not applied to the boom operation device 20 (including a case where the boom lowering command operation is applied to the boom operation device 20; NO in step S3), in other words, when only the slewing command operation is performed out of the slewing command operation and the boom raising command operation, the motor capacity command unit 76 of the controller 70 inputs no capacity switching signal to the oil pressure supply selector valve 64, thereby making the slewing motor capacity qms be the second capacity qms2, that is, a small capacity (step S4).

The purpose of thus setting the slewing motor capacity qms to the second capacity qms2, which is a small capacity, is to protect devices or the like from damage due to over torque. With no boom raising command operation applied to the boom operation device 20, the combined-flow selector valve 24 is shifted to the combined flow prevention position to cause the hydraulic oil discharged from the first hydraulic pump 11 to be supplied only to the slewing motor unit 14 out of the boom cylinder 7 and the slewing motor unit 14, while the working pressure of the motor body 26 of the slewing motor unit 14 is likely to be high pressure during the performance of a single slewing operation; in this case, the slewing motor capacity qms is shifted to the second capacity qms2 as described above for prevention of over torque. However, even during the single slewing operation, it is also permissible to switch the slewing motor capacity qms to the first capacity qms1, that is, a large capacity, when slewing is desired with full use of the ability of the slewing motor unit 14.

On the other hand, when the boom raising command operation is applied to the boom operation device 20 in addition to the slewing command operation (YES in step S3), that is, when the boom raising pilot pressure is being output from the boom operation device 20 to shift the combined-flow selector valve 24 to the combined-flow allowing position to allow the hydraulic oil from the first hydraulic pump 11 to be distributed and supplied to the slewing motor unit 14 and the pair of boom cylinders 7, the controller 70 executes the control for appropriate distribution of the energy of the hydraulic oil discharged from the first and second hydraulic pumps 11 and 12 to the slewing motor unit 14 and the boom cylinder 7 (steps S4 to S9).

First, the actual slewing flow rate ratio calculation unit 72 of the controller 70 calculates the actual slewing flow rate ratio Rqs (step S5). Specifically, based on the first and second pump capacities qp1 and qp2 [cc/rev] of the first and second pumps 11 and 12 operated by the pump capacity command unit 71, the motor speed Nms [rpm] detected by the motor speed sensor 84, the engine speed Ne [rpm] detected by the engine speed sensor 80, and the slewing motor capacity qms [cc/rev], the actual slewing flow rate ratio calculation unit 72 calculates the pump flow rate Qp that is the sum of flow rates of the hydraulic oil discharged from the first and second hydraulic pumps 11 and 12 and the slewing flow rate Qs that is the flow rate of the hydraulic oil supplied from the first hydraulic pump 11 to the slewing motor unit 14, by use of the following equations (1) and (2), and further calculates the actual slewing flow rate ratio Rqs (=Qs/Qp).

$$Qp=(qp1+qp2)\times Ne/1000 \text{ [cc/min]} \quad (1)$$

$$Qs=qms\times Nms/1000 \text{ [cc/min]} \quad (2)$$

The actual slewing flow rate ratio Rqs gradually increases after the slewing and boom-raising operation is started. Specifically, the flow rate of the hydraulic oil flowing through the slewing motor body 26 of the slewing motor unit 14, that is, the slewing flow rate Qs, immediately after the slewing is started is small because starting slewing of the upper slewing body 2 having a large moment of inertia from its stopped state requires large slewing torque, while the slewing flow rate Qs increases with advance of the slewing of the upper slewing body 2. Moreover, since the change is greater than that in the flow rate of the hydraulic oil supplied to the boom cylinder 7, the actual slewing flow rate ratio Rqs, as a whole, increases with the passage of time from the start of the sewing and boom-raising operation.

Meanwhile, the boom raising working pressure determination unit 73 of the controller 70 determines the boom raising working pressure Pbr during the performance of the slewing and boom-raising operation based on the first and second pump pressure P1 and P2 detected by the first and second pump pressure sensors 81 and 82 (step S6). The boom raising working pressure Pbr, which is basically higher than the slewing working pressure in the slewing motor unit 14 (motor differential pressure of the slewing motor body 26), can be regarded as equivalent to discharge pressure of the first and second pumps 11 and 12 (first and second pump pressure P1 and P2) except for pressure loss in the boom control valve 22 and the combined-flow selector valve 24. Hence, the boom raising working pressure determination unit 73 determines the average value of the first and second pump pressure P1 and P2, that is, average pump pressure Pav (=(P1+P2)/2) as the boom raising working pressure Pbr.

Figure 4:
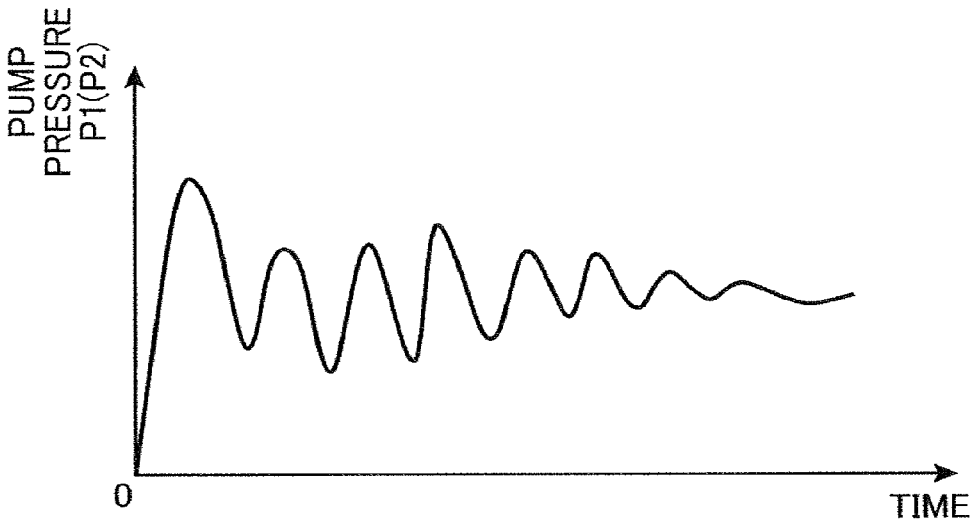
FIG. 4 is a graph showing temporal fluctuation of a pump pressure detection signal generated by a pump pressure sensor of the hydraulic excavator.

Although the determination of the boom raising working pressure Pbr may be performed by adopting directly respective values of the first and second pump pressure P1 and P2 detected by the first and second pump pressure sensors 81 and 82 immediately after the start of the slewing and boom-raising operation, it is more preferable to adopt a value excluding respective fluctuations in the pump pressure P1 and P2 that is wide particularly at the beginning of the slewing and boom-raising operation, as exemplified in FIG. 4. The boom raising working pressure determination unit 73 according to the embodiment performs filter-processing of the pump pressure detection signals that is input from the first and second pump pressure sensors 81 and 82 to eliminate high-frequency components from the pump pressure detection signals as illustrated in FIG. 5, and determines the first and second pump pressure P1 and P2 for determining the boom raising working pressure Pbr based on the pump pressure detection signals, after the values of the pump pressure detection signals that have undergone the filter-processing comes into satisfying a preset convergence judgment condition.

Figure 5:
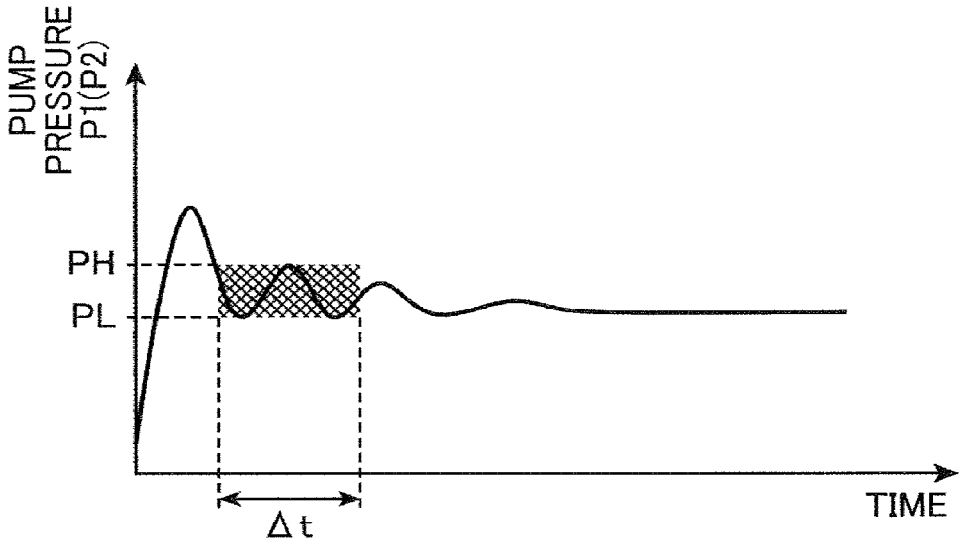
FIG. 5 is a graph showing temporal fluctuation after performing filter-processing on the pump pressure detection signal.

Specifically, since the pump pressure detection signals behaves to run into damped oscillation (that is, to change between maximal values and minimal values alternately) after reaching the first maximal value as exemplified in FIG. 5, preferred examples of the convergence judgment condition include (1) the pump pressure detection signals reach the first minimal value PL (minimal value next to the first maximal value), (2) the pump pressure detection signals reach the second maximal value PH, and the like. Besides, preferred examples of the method for determining the first and second pump pressure P1 and P2 based on the pump pressure detection signals after satisfaction of the convergence judgment condition include: adopting the first minimal value PL directly as each of the first and second pump pressure P1 and P2; calculating the average value of the pump pressure detection signals within a period of a certain time Δt after the point when the convergence judgment condition becomes satisfied (the period shown as mesh in FIG. 5) as the first and second pump pressure P1 and P2; calculating the average value of the first minimal value PL and the second maximal value PH as first and second pump pressure P1 and P2; and the like.

Next, the boundary value setting unit 74 of the controller 70 sets the flow rate ratio boundary value Rqsb, which is a boundary value of the actual slewing flow rate ratio Rqs, based on the boom raising working pressure Pbr (step S7). Specifically, the flow rate ratio boundary value Rqsb is set at a smaller value as the boom raising working pressure Pbr increases.

Figure 6:
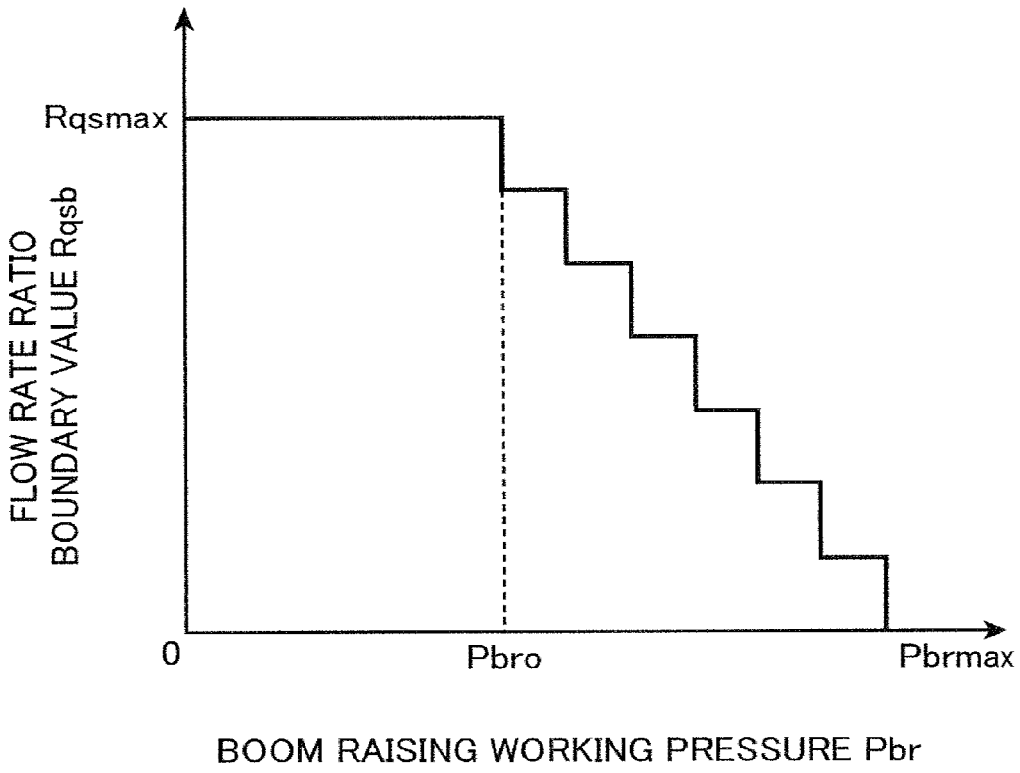
FIG. 6 is a graph showing details of a flow rate ratio boundary value map stored in a boundary value setting unit in the controller.

The boundary value setting unit 74 according to the embodiment stores the flow rate ratio boundary value map as described above, and determines the flow rate ratio boundary value Rqsb based on the flow rate ratio boundary value map. FIG. 6 shows a preferred example of the flow rate ratio boundary value map. According to this map, the flow rate ratio boundary value Rqsb is set at the maximum value Rqmsax in a region where the boom raising working pressure Pbr is equal to or lower than the preset priority working pressure Pbro, while the flow rate ratio boundary value Rqsb is set such that the flow rate ratio boundary value Rqsb decreases stepwise with increase in the boom raising working pressure Pbr in a region where the boom raising working pressure Pbr exceeds the priority working pressure Pbro. Besides, when the boom raising working pressure Pbr exceeds a preset upper limit working pressure Pbrmax, the flow rate ratio boundary value Rqsb is set to zero.

In the case where an operator inputs, in advance, the map change command to the flow rate ratio boundary value map setting unit 78 by operating the operation display 88, the flow rate ratio boundary value map is appropriately changed according to the contents of the map change command. This allows the balance between the slewing speed and the boom raising speed according to the operator's feeling to be changed.

The slewing motor capacity command unit 76 judges the necessity of the input of the capacity switching signal to the oil pressure supply selector valve 64, based on comparison between the actual slewing flow rate ratio Rqs and the flow rate ratio boundary value Rqsb (step S8). Specifically, in the slewing priority allowable period until the actual slewing flow rate ratio Rqs reaches the flow rate ratio boundary value Rqsb (NO in step S8), the motor capacity command unit 76 switches the slewing motor capacity qms to the first capacity (large capacity) qms1 to give priority to securing the slewing torque for rapid slewing start (step S9). More specifically, the motor capacity command unit 76 inputs the capacity switching signal to the oil pressure supply selector valve 64 to shift the oil pressure supply selector valve 64 to the first switching position. Thus shifted oil pressure supply selector valve 64 allows the capacity switching hydraulic pressure to be introduced into the first hydraulic chamber 55 of the capacity operation cylinder 52 to switch the slewing motor capacity qms to the first capacity qms1. At the time when the actual slewing flow rate ratio Rqs thereafter reaches the flow rate ratio boundary value Rqsb (YES in step S8), that is, at the time after the slewing priority allowable period has elapsed and when the slewing has progressed to some extent, the motor capacity command unit 76 stops inputting the capacity switching signal to the oil pressure supply selector valve 64 to give priority to the boom raising drive, and returns the slewing motor capacity qms to the second capacity (small capacity) qms2 (step S4).

Since the flow rate ratio boundary value Rqsb here is set at a smaller value as the boom raising working pressure Pbr increases as described above, the slewing motor capacity qms is switched from the first capacity qms1 to the second capacity qms2 at an earlier point in time with increase in the boom raising working pressure Pbr. This makes it possible to secure the long slewing priority allowable period to raise the priority of the slewing drive when the load for the boom rising motion is small, and to shorten the slewing priority allowable period to raise the priority of the boom raising drive when the load for the boom raising operation is large, thereby effectively assisting an operator to cause the slewing motion and the boom rising motion simultaneously with a suitable balance regardless of the load for the boom raising operation.

Besides, in this embodiment, the flow rate ratio boundary value Rqsb is set to zero, when the boom raising working pressure Pbr exceeds the preset upper limit working pressure Pbrmax, thereby causing the motor capacity command unit 76 to stop the input of the capacity switching signal from the slewing start regardless of the actual slewing flow rate ratio Rqs to keep the slewing motor capacity qms at the second capacity qms2. This effectively prevents the slewing motor capacity from being increased to generate excessive slewing torque in the slewing motor when the boom raising working pressure Pbr is excessively high, that is, when the pump pressure P1 and P2 is excessively high. This effect can be obtained, in the case where the boom raising working pressure Pbr exceeds the upper limit working pressure Pbrmax, by not only setting the flow rate ratio boundary value Rqsb to zero by the boundary value setting unit 74 but also forcibly switching the slewing motor capacity qms to the second capacity, regardless of the actual slewing flow rate ratio Rqs and the flow rate ratio boundary value Rqsb, by the slewing motor capacity command unit 76.

The present invention is not limited to the embodiment described above. The present invention also includes, for example, the following aspects.

(A) Regarding Actual Slewing Distribution Factor Correspondence Value

The actual slewing distribution factor correspondence value according to the present invention is not limited to the actual slewing flow rate ratio Rqs. The actual slewing distribution factor correspondence value may be set to any value that increases or decreases in response to the slewing energy distribution ratio that is a ratio of energy actually distributed to the slewing motor to the energy of the hydraulic oil discharged from the oil pressure supply device (first and second hydraulic pumps 11 and 12 in the embodiment).

Figure 8:
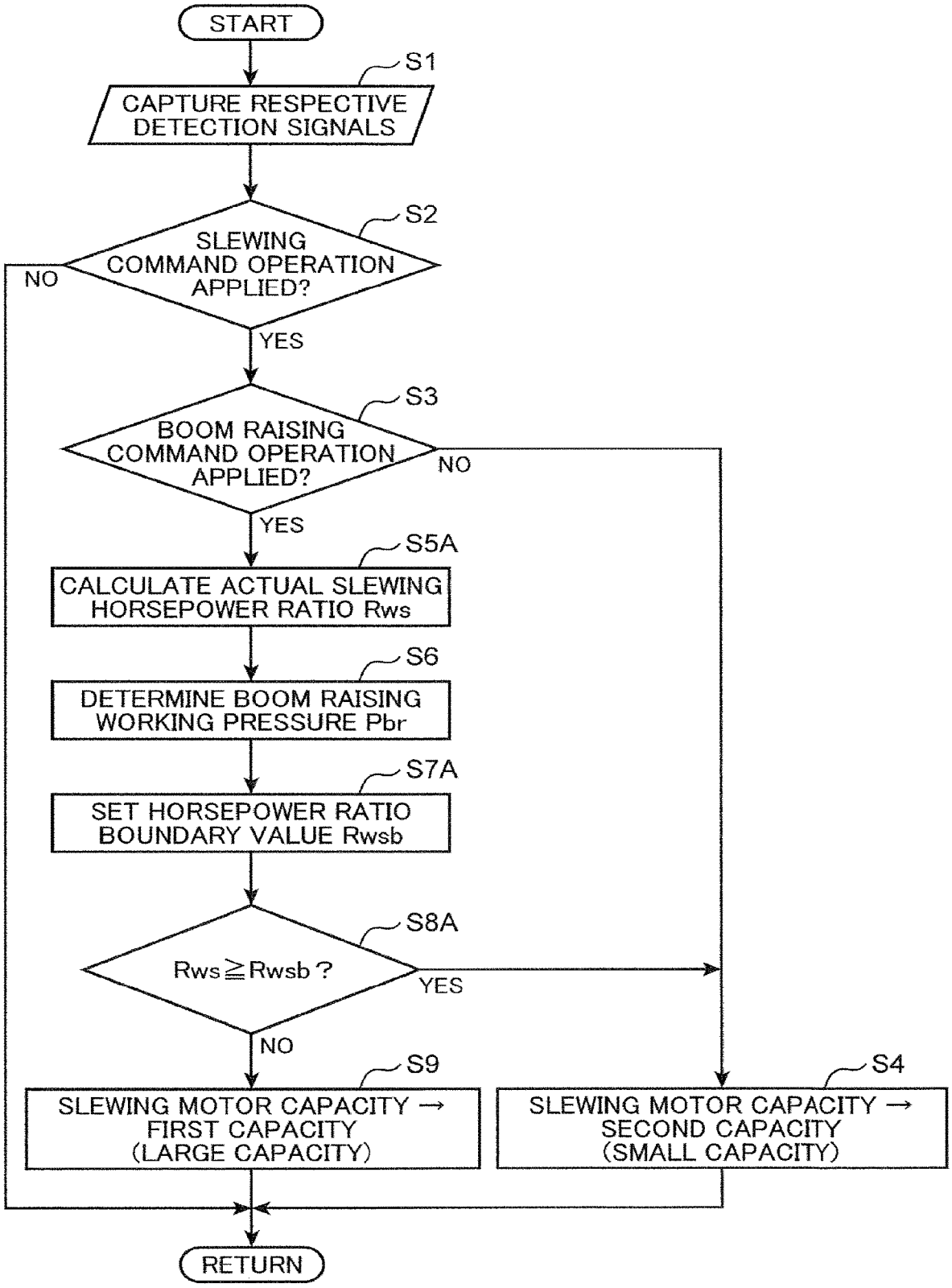
FIG. 8 is a flowchart showing a modification of the arithmetic control operation.

The actual slewing distribution factor correspondence value may be, for example, an actual slewing horsepower ratio Rws that is a ratio of the slewing horsepower Ws actually distributed to the slewing motor to the total horsepower of the oil pressure supply device. FIG. 8 shows a modification of an arithmetic control operation with use of the actual slewing horsepower ratio Rws as the actual slewing distribution factor correspondence value instead of the actual slewing flow rate ratio Rqs according to the embodiment.

In this modification, during the performance of the slewing and boom-raising operation (YES in steps S2 and S3), the actual slewing horsepower ratio Rws is calculated (step S5A) instead of the actual slewing flow rate ratio Rqs according to the embodiment. The actual slewing horsepower Rws is a ratio of the slewing horsepower Ws to a pump horsepower (total horsepower) Wp that is a sum of horsepowers W1 and W2 of the first and second hydraulic pumps 11 and 12, respectively (Rws=Ws/Wp). Respective horsepowers W1 and W2 of the first and second pumps 11 and 12 and the slewing horsepower Ws can be calculated, for example, by use of the following equations (3) and (4), respectively, and based on the first and second pump pressure P1 and P2, the engine speed Ne [rem], the motor speed Nms [rem], the first and second pump capacities qp1 and qp2 [cc/rev], motor differential pressure ΔP that is a difference between respective pressures across the slewing motor body 26, and the slewing motor capacity qms [cc/rev].

$$W1=P1\times(Ne\times qp1/1000)/60\ [\text{kW}] \quad (3)$$

$$Ws=\Delta P\times qms\times Nms/60\ [\text{kW}] \quad (4)$$

wherein, the motor differential pressure ΔP can be detected by pressure sensors disposed on both sides of the slewing motor body 26, and the slewing motor capacity qms can be calculated, for example, from a motor instruction current value. In the case of use of a sensor that detects not the motor speed Nms but the rotation rate Nsw of the upper slewing body 2, the motor speed Nms can be calculated by dividing the rotation rate Nsw by a motor speed reduction ratio.

Meanwhile, similarly to steps S6 and S7 in the control according to the embodiment, performed are determination of the boom raising working pressure Pbr (Step S6) and determination of a horsepower ratio boundary value Rwsb, which is a boundary value of the actual slewing horsepower ratio Rws (step S7A). As with the flow rate ratio boundary value Rqsb, the horsepower ratio boundary value Rwsb is set at a smaller value as the boom raising working pressure Pbr increases. Then, during the period after the start of the slewing and boom-raising operation until the actual slewing horsepower ratio Rws reaches the horsepower ratio boundary value Rwsb (NO in step S8A), the slewing motor capacity qms is maintained at the first capacity qms1 (step S9), and, at the time when the actual slewing horsepower ratio Rws reaches the horsepower ratio boundary value Rwsb (YES in step S8A), the slewing motor capacity qms is switched to the second capacity qms2 (<qms1) (step S4), thus suitable distribution control being implemented in consideration with the load for boom raising.

The actual slewing distribution factor correspondence value may alternatively be a value that decreases with increase in the slewing energy distribution ratio. For example, the actual slewing distribution correspondence value may be a boom raising flow rate ratio Rqb (=Qb/Qp) that is a ratio of the flow rate (boom raising flow rate) Qb of the hydraulic oil actually distributed to the boom cylinder 7 to the pump flow rate Qp that is the flow rate of the hydraulic oil discharged from the first and second hydraulic pumps 11 and 12 according to the embodiment. The flow rate of the hydraulic oil supplied from the first hydraulic pump 11 to the boom cylinder 7 through the combined-flow selector valve 24, included in the boom raising flow rate Qb, can be calculated, for example, based on the difference between respective pressures across the combined-flow selector valve 24 and the opening area of the combined-flow selector valve 24 corresponding to the boom raising pilot pressure.

In this case, the boom raising flow rate ratio decreases with increase in the slewing flow rate. Hence, the boundary value of the boom raising flow rate ratio is set to a larger value with increase in the boom raising working pressure in order to increase the degree of restriction of the slewing motor capacity with increase in the boom raising working pressure.

(B) Regarding Setting of Boundary Value of Actual Slewing Distribution Factor Correspondence Value The boundary value map for setting the boundary value of the actual slewing distribution factor correspondence value based on the boom raising working pressure is not limited to the map shown in FIG. 6. The boundary value map may be based on, for example, a characteristic in which the boundary value decreases continuously with increase in the boom raising working pressure (for example, the boundary value increases continuously when the actual slewing distribution factor correspondence value is the boom raising flow rate ratio). Besides, the setting of the boundary value is not limited to one involving use of a prepared map. The setting may be performed, for example, by calculation based on a prepared relational expression between the boom raising working pressure and the boundary value.

(C) Regarding Slewing Motor Capacity

The slewing motor according to the present invention may have a slewing motor capacity that is not selectively switched from among a plurality of values but continuously variable. In the latter case, the motor capacity operation unit may perform an operation of decreasing the slewing motor capacity with increase in the boom raising working pressure while restraining the slewing motor capacity from dropping below a preset limit capacity, in the slewing priority allowable period until the actual slewing distribution factor correspondence value reaches the boundary value. Besides, after the actual slewing distribution factor correspondence value reaches the boundary value, an operation may be performed to further decrease the slewing motor capacity beyond the limit capacity with increase in the boom raising working pressure.

(D) Regarding Oil Pressure Supply Device

At least one hydraulic pump of the oil pressure supply device according to the present invention may include only a distribution pump. In other words, it is also possible to drive both the slewing motor and the boom actuator by only the hydraulic oil discharged from the distribution pump.

(E) Regarding Slewing Control Device and Boom Control Device

The slewing control device and the boom control device according to the present invention are only required to control supply of the hydraulic oil from the oil pressure supply device to the slewing motor and the boom actuator in accordance with the slewing command operation and the boom command operation applied to the slewing control device and the boom control device, respectively, thus not being limited to those including the hydraulic pilot type slewing operation device 16 and the boom operation device 20 including the pilot valves 16*b* and 20*b* as in the embodiment. The slewing control device according to the present invention may include, instead of the slewing operation device 16, for example, an electric lever device that generates a slewing command signal that is an electric signal in response to a slewing command operation applied to the electric lever device by an operator, a controller that calculates slewing pilot pressure based on the slewing command signal and calculates and outputs a slewing operation signal corresponding to the slewing pilot pressure, and an electromagnetic pressure control valve that changes the slewing pilot pressure to be input from the pilot oil pressure source to the slewing control valve 18 in response to the input of the slewing operation signal. Similarly, the boom control device according to the present invention may include, instead of the boom operation device 20, an electric lever device that generates a boom command signal that is an electric signal in response to a boom command operation applied to the electric lever device by an operator, a controller that calculates boom pilot pressure based on the boom command signal and calculates and outputs a corresponding boom operation signal corresponding to the boom pilot pressure, and an electromagnetic pressure control valve that changes the boom raising pilot pressure or the boom lowering pilot pressure to be input from the pilot oil pressure source to the boom control valve 22 in response to the input of the boom operation signal.

As described above, there is provided a slewing-type hydraulic work machine that includes a slewing motor that slews an upper slewing body, a boom actuator that raises and lowers a boom of a work device, and a hydraulic pump connected to each of the slewing motor and the boom actuator, the slewing-type hydraulic work machine being capable of causing the boom to make a rising motion at a sufficient speed regardless of working pressure of the boom actuator while securing sufficient slewing torque for slewing start, during the performance of a slewing and boom-raising operation.

Provided is a slewing-type hydraulic work machine including: a lower travelling body; an upper slewing body mounted on the lower travelling body so as to be capable of being slewed; a work device mounted on the upper slewing body, the work device including a boom connected to the upper slewing body so as to be capable of being raised and lowered; a slewing motor formed of a variable displacement type hydraulic motor and operated by hydraulic oil supplied to the slewing motor to slew the upper slewing body in response to the supply of the hydraulic oil; a boom actuator that is operated by hydraulic oil supplied to the boom actuator to raise and lower the boom; an oil pressure supply device including at least one hydraulic pump that discharges hydraulic oil to be supplied to the variable displacement type hydraulic motor and the boom actuator, the at least one hydraulic pump including a distribution pump that is connectable to both the slewing motor and the boom actuator to distribute the hydraulic oil to the slewing motor and the boom actuator; a slewing control device configured to control a direction and a flow rate of the hydraulic oil supplied from the oil pressure supply device to the slewing motor in accordance with a slewing command operation that is applied to the slewing control device for slewing the upper slewing body; a boom control device configured to control a flow rate of the hydraulic oil supplied from the oil pressure supply device to the boom actuator in accordance with a boom raising command operation that is applied to the boom control device for actuating the boom in a rising direction; a boom raising working pressure detection unit that detects boom raising working pressure corresponding to pressure of the hydraulic oil supplied from the oil pressure supply device to the boom actuator to drive the boom in the rising direction; and a capacity control device configured to control a slewing motor capacity that is a capacity of the slewing motor based on the boom raising working pressure detected by the boom raising working pressure detection unit during a performance of a slewing and boom-raising operation in which the slewing command operation is applied to the slewing control device and the boom raising command operation is applied to the boom control device, simultaneously. The capacity control device includes: a distribution factor correspondence value detection unit that detects an actual slewing distribution factor correspondence value that is a value that increases and decreases correspondingly to a slewing energy distribution factor that is a ratio of energy actually distributed to the slewing motor to energy of the hydraulic oil discharged from the oil pressure supply device during the performance of the slewing and boom-raising operation; a boundary value setting unit that sets a boundary value for the actual slewing distribution factor correspondence value, the boundary value setting unit configured to change the boundary value according to the boom raising working pressure to limit the slewing energy distribution factor more strictly with increase in the boom raising working pressure; and a motor capacity operation unit configured to render the slewing motor capacity higher than a preset limit capacity within a slewing priority allowable period after the slewing motor starts until the actual slewing distribution factor correspondence value reaches the boundary value during the performance of the slewing and boom-raising operation and configured to limit the slewing motor capacity to the limit capacity or less after the actual slewing distribution factor correspondence value reaches the boundary value.

In this slewing-type hydraulic work machine, during the performance of the slewing and boom-raising operation, the capacity operation unit of the capacity control device can give priority to securing the slewing torque required for starting slewing, by setting the slewing motor capacity to a capacity larger than the preset limit capacity, at least in an early stage of slewing, specifically, in the slewing priority allowable period until the actual slewing distribution factor correspondence value detected by the distribution factor correspondence value detection unit reaches the boundary value determined by the boundary value setting unit; in contrast, the capacity operation unit can give priority to the boom rising motion by the driven boom actuator, by limiting the slewing motor capacity to the limit capacity or less, after the actual slewing distribution factor correspondence value reaches the boundary value, that is, after the slewing speed is increased to some extent. Moreover, the boundary value setting unit, which changes the boundary value according to the boom raising working pressure so as to limit the slewing energy distribution factor more strictly with increase in the boom raising working pressure, enables the slewing motor capacity to be limited to the limit capacity or less at an earlier stage with increase in the boom raising working pressure, that is, enables the priority of the boom raising operation to be raised as the boom raising working pressure becomes higher. Such energy distribution control allows the slewing motion and the boom rising motion to be made at a stable speed during the performance of the slewing and boom-raising operation, regardless of the boom raising working pressure.

The actual slewing distribution factor correspondence value is only required to be increased or decreased in response to the slewing energy distribution ratio that is a ratio of energy actually distributed to the slewing motor to the energy of the hydraulic oil discharged from the oil pressure supply device, being not required to be the ratio of the energy itself. For example, in the case where the actual slewing distribution factor correspondence value is a value that increases correspondingly to the slewing energy distribution atie factor, the boundary value setting unit is configured to set the boundary value at a smaller value with increase in the boom raising working pressure.

Preferably, such an actual slewing distribution factor correspondence value is, for example, an actual slewing flow rate ratio that is a ratio of the flow rate of the hydraulic oil actually supplied to the slewing motor to the flow rate of the hydraulic oil discharged from the oil pressure supply device. Specifically, it is preferred that the distribution factor correspondence value detection unit is configured to detect the actual slewing flow rate ratio as the actual slewing distribution factor correspondence value, and that the boundary value setting unit is configured to set the boundary value of the actual slewing flow rate ratio.

In this case, the distribution factor correspondence value detection unit is configured to perform, for example, calculating a pump flow rate that is the flow rate of the hydraulic oil discharged from the oil pressure supply device based on a pump capacity that is a capacity of the at least one hydraulic pump of the oil pressure supply device and a rotational speed of the at least one hydraulic pump of the oil pressure supply device, calculating a slewing flow rate that is a flow rate of the hydraulic oil supplied to the slewing motor based on the rotational speed and the slewing motor capacity of the slewing motor, and calculating a ratio of the slewing flow rate to the pump flow rate as the actual slewing flow rate ratio; this allows the actual slewing flow rate ratio to be determined with a simple configuration.

The slewing motor capacity of the slewing motor may be either continuously variable or selectable between a first capacity larger than the limit capacity and the second capacity corresponding to the limit capacity. In the latter case, the capacity operation unit of the capacity control device is preferably configured to make the slewing motor capacity be the first capacity in the slewing priority allowable period and to make the slewing motor capacity be the second capacity after the slewing priority allowable period has elapsed; this enables accurate energy distribution control to be executed during the performance of the slewing and boom-raising operation with use of the simple variable displacement type hydraulic motor as the slewing motor.

The at least one hydraulic pump in the oil pressure supply device may include either a distribution pump alone or a further hydraulic pump other than the distribution pump. In the latter case, it is preferable that the at least one hydraulic pump includes a first hydraulic pump that is the distribution pump and connectable to the slewing motor and a second hydraulic pump connectable to the boom actuator, the boom control device including a combined-flow selector valve interposed between the first hydraulic pump and the boom actuator and configured to be opened, only when the boom raising operation is applied to the boom control device, to allow the hydraulic oil discharged from the first hydraulic pump to be combined with the hydraulic oil discharged from the second hydraulic pump and supplied to the boom actuator. In this configuration, applying the above-described distribution control to the supply of the hydraulic oil from the first hydraulic pump to the slewing motor and the boom actuator during the performance of the slewing and boom-raising operation allows a good balance to be provided between slewing by the supply of hydraulic oil from the first hydraulic pump to the slewing motor and boom raising by the supply of hydraulic oil from the first and second hydraulic pumps to the boom actuator.

The boom raising working pressure detection unit preferably includes, for example, a pump pressure detector that detects a pump pressure that is a pressure of the hydraulic oil discharged from the at least one hydraulic pump of the oil pressure supply device, and a boom raising working pressure determination unit that determines the boom raising working pressure based on the pump pressure detected by the pump pressure detector after a satisfaction of a convergence judgment condition that is set in advance to judge convergence of fluctuation of the pump pressure within an allowable range after the slewing motor starts. This allows the boom raising working pressure to be determined appropriately. During the performance of the slewing and boom-raising operation, the boom raising working pressure, which is higher than the working pressure of the slewing motor, generally corresponds to the pump pressure, while the pump pressure fluctuates significantly at the start of slewing. Therefore, the pump pressure after the satisfaction of the convergence judgment condition set in advance to judge the convergence of the fluctuation of the pump pressure after the slewing motor is started allows the appropriate boom raising working pressure to be determined based thereon.

The capacity operation unit is preferably configured to limit the slewing motor capacity to the limit flow rate or less regardless of the actual slewing distribution factor correspondence value when the boom raising working pressure exceeds an upper limit working pressure set in advance. This effectively prevents the slewing motor capacity from being increased to cause excessive slewing torque in the slewing motor when the boom raising working pressure is excessively high, that is, when the pump pressure is excessively high.

The invention claimed is:

1. A slewing-type hydraulic work machine comprising:

a lower travelling body;

an upper slewing body mounted on the lower travelling body so as to be capable of being slewed;

a work device mounted on the upper slewing body, the work device including a boom connected to the upper slewing body so as to be capable of being raised and lowered;

a slewing motor formed of a variable displacement type hydraulic motor and operated by hydraulic oil supplied to the slewing motor to slew the upper slewing body in response to the supply of the hydraulic oil;

a boom actuator that is operated by hydraulic oil supplied to the boom actuator to raise and lower the boom;

an oil pressure supply device including at least one hydraulic pump that discharges hydraulic oil to be supplied to the variable displacement type hydraulic motor and the boom actuator, the at least one hydraulic pump including a distribution pump that is connectable to both the slewing motor and the boom actuator to distribute the hydraulic oil to the slewing motor and the boom actuator;

a slewing control device configured to control a direction and a flow rate of the hydraulic oil supplied from the oil pressure supply device to the slewing motor in accordance with a slewing command operation that is applied to the slewing control device for slewing the upper slewing body;

a boom control device configured to control a flow rate of the hydraulic oil supplied from the oil pressure supply device to the boom actuator in accordance with a boom raising command operation that is applied to the boom control device for actuating the boom in a rising direction;

a boom raising working pressure detection unit that detects boom raising working pressure corresponding to pressure of the hydraulic oil supplied from the oil pressure supply device to the boom actuator to drive the boom in a rising direction; and a capacity control device configured to control a slewing motor capacity that is a capacity of the slewing motor based on the boom raising working pressure detected by the boom raising working pressure detection unit during a performance of a slewing and boom-raising operation in which the slewing command operation is applied to the slewing control device and the boom raising command operation is applied to the boom control device, simultaneously, wherein:

the capacity control device includes a distribution factor correspondence value detection unit that detects an actual slewing distribution factor correspondence value that is a value that increases and decreases correspondingly to a slewing energy distribution factor that is a ratio of energy actually distributed to the slewing motor to energy of the hydraulic oil discharged from the oil pressure supply device during the performance of the slewing and boom-raising operation, a boundary value setting unit that sets a boundary value for the actual slewing distribution factor correspondence value, the boundary value setting unit configured to change the boundary value according to the boom raising working pressure to limit the slewing energy distribution factor more strictly with increase in the boom raising working pressure; and a motor capacity operation unit configured to render the slewing motor capacity higher than a preset limit capacity within a slewing priority allowable period after the slewing motor starts until the actual slewing distribution factor correspondence value reaches the boundary value during the performance of the slewing and boom-raising operation and configured to limit the slewing motor capacity to the limit capacity or less after the actual slewing distribution factor correspondence value reaches the boundary value.

2. The slewing-type hydraulic work machine according to claim 1, wherein the actual slewing distribution factor correspondence value is a value that increases correspondingly to the slewing energy distribution factor, and the boundary value setting unit sets the boundary value at a smaller value with increase in the boom raising working pressure.

3. The slewing-type hydraulic work machine according to claim 2, wherein the distribution factor correspondence value detection unit is configured to detect an actual slewing flow rate ratio that is a ratio of the flow rate of the hydraulic oil actually supplied to the slewing motor to the flow rate of the hydraulic oil discharged from the oil pressure supply device as the actual slewing distribution factor correspondence value, and wherein the boundary value setting unit is configured to set the boundary value of the actual slewing flow rate ratio.

4. The slewing-type hydraulic work machine according to claim 3, wherein the distribution factor correspondence value detection unit is configured to perform calculating a pump flow rate that is the flow rate of the hydraulic oil discharged from the oil pressure supply device based on a pump capacity that is a capacity of the at least one hydraulic pump of the oil pressure supply device and a rotational speed of the at least one hydraulic pump of the oil pressure supply device, calculating a slewing flow rate that is a flow rate of the hydraulic oil supplied to the slewing motor based on the rotational speed and the slewing motor capacity of the slewing motor, and calculating a ratio of the slewing flow rate to the pump flow rate as the actual slewing flow rate ratio.

5. The slewing-type hydraulic work machine according to claim 1, wherein the slewing motor capacity of the slewing motor is selectable between a first capacity greater than the limit capacity and a second capacity corresponding to the limit capacity, and wherein the capacity operation unit of the capacity control device is configured to make the slewing motor capacity be the first capacity in the slewing priority allowable period and configured to make the slewing motor capacity be the second capacity after the slewing priority allowable period elapses.

6. The slewing-type hydraulic work machine according to claim 1, wherein the at least one hydraulic pump in the oil pressure supply device includes a first hydraulic pump that is the distribution pump and connectable to the slewing motor and a second hydraulic pump connectable to the boom actuator, and wherein the boom control device includes a combined-flow selector valve interposed between the first hydraulic pump and the boom actuator and the combined-flow selector valve and configured to be opened, only when the boom raising operation is applied to the boom control device, to allow the hydraulic oil discharged from the first hydraulic pump to be combined with the hydraulic oil discharged from the second hydraulic pump and supplied to the boom actuator.

7. The slewing-type hydraulic work machine according to claim 1, wherein the boom raising working pressure detection unit includes a pump pressure detector that detects a pump pressure that is a pressure of the hydraulic oil discharged from the at least one hydraulic pump of the oil pressure supply device, and a boom raising working pressure determination unit that determines the boom raising working pressure based on the pump pressure detected by the pump pressure detector after a satisfaction of a convergence judgment condition that is set in advance to judge convergence of fluctuation of the pump pressure within an allowable range after the slewing motor starts.

8. The slewing-type hydraulic work machine according to claim 1, wherein the capacity operation unit is configured to limit the slewing motor capacity to the limit flow rate or less regardless of the actual slewing distribution factor correspondence value when the boom raising working pressure exceeds an upper limit working pressure set in advance.

* * * * *